US009260768B2

(12) United States Patent
Liu et al.

(10) Patent No.: US 9,260,768 B2
(45) Date of Patent: Feb. 16, 2016

(54) LEAD-FREE SOLDER ALLOYS AND SOLDER JOINTS THEREOF WITH IMPROVED DROP IMPACT RESISTANCE

(75) Inventors: Weiping Liu, Utica, NY (US); Ning-Cheng Lee, New Hartford, NY (US)

(73) Assignee: Indium Corporation, Clinton, NY (US)

( * ) Notice: Subject to any disclaimer, the term of this patent is extended or adjusted under 35 U.S.C. 154(b) by 793 days.

(21) Appl. No.: 11/567,525

(22) Filed: Dec. 6, 2006

(65) Prior Publication Data

US 2007/0134125 A1 Jun. 14, 2007

Related U.S. Application Data

(60) Provisional application No. 60/749,615, filed on Dec. 13, 2005.

(51) Int. Cl.
*C22C 13/00* (2006.01)
*C22C 13/02* (2006.01)

(52) U.S. Cl.
CPC ..... *C22C 13/00* (2013.01); *C22C 13/02* (2013.01)

(58) Field of Classification Search
USPC ..... 148/400; 420/561, 560
IPC ..... C22C 13/00,13/02
See application file for complete search history.

(56) References Cited

U.S. PATENT DOCUMENTS

| | | | | |
|---|---|---|---|---|
| 5,863,493 | A | 1/1999 | Achari et al. | |
| 6,228,322 | B1 * | 5/2001 | Takeda et al. | 420/561 |
| 6,517,602 | B2 | 2/2003 | Sato et al. | |
| 6,805,974 | B2 | 10/2004 | Choi et al. | |
| 2002/0192106 | A1 | 12/2002 | Takaoka et al. | |
| 2004/0070915 | A1 | 4/2004 | Nagai et al. | |
| 2005/0100474 | A1 | 5/2005 | Huang et al. | |
| 2008/0271997 | A1 | 11/2008 | Facey et al. | |

FOREIGN PATENT DOCUMENTS

| | | | |
|---|---|---|---|
| CN | 1398696 | | 2/2003 |
| CN | 140081 | | 3/2003 |
| CN | 1586792 | * | 3/2005 |
| CN | 1586792 A | | 3/2005 |
| CN | 1621196 | | 6/2005 |
| CN | 1887500 | | 1/2007 |

(Continued)

OTHER PUBLICATIONS

Kim, K.S.; Huh, S.H.; Suganuma, K.,Effeects of fourth alloying additive on microstructures and tensile properties of Sn—Ag—Cu alloy and joints with Cu, Microelectronics Reliability (2003), 43(2), 259-267. (provided with abstract only).*

(Continued)

*Primary Examiner* — Sikyin Ip

(74) *Attorney, Agent, or Firm* — Sheppard Mullin Richter & Hampton LLP

(57) ABSTRACT

Lead-free solder alloys and solder joints thereof with improved drop impact resistance are disclosed. In one particular exemplary embodiment, the lead-free solder alloys preferably contain 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

20 Claims, 7 Drawing Sheets

(56) References Cited

FOREIGN PATENT DOCUMENTS

| | | | |
|---|---|---|---|
| CN | 101072886 | | 11/2007 |
| EP | 0435009 | A | 7/1991 |
| EP | 1245328 | | 2/2002 |
| JP | 2179386 | * | 7/1990 |
| JP | 02179386 | * | 7/1990 |
| JP | 11216591 | * | 8/1999 |
| JP | 11216591 | A | 8/1999 |
| JP | 2002248596 | * | 9/2002 |
| JP | 2005014076 | * | 1/2005 |
| JP | 2005014076 | A | 1/2005 |
| JP | 2005/118800 | | 5/2005 |
| JP | 2005254298 | * | 9/2005 |
| JP | 2008/218318 | | 9/2008 |
| WO | WO 2004113013 | | 12/2004 |
| WO | WO-2007/070548 | | 6/2007 |

OTHER PUBLICATIONS

International Search Report dated Oct. 3, 2007 for Application No. PCT/US06/47476.

C. Chiu, et al., "Effect of Thermal Aging on Board Level Drop Reliability for Pb-free BGA Packages", ECTC, p. 1256, Jun. 2004.

D. Henderson, "On the question of SAC solder alloy—Cu pad solder joint fragility", Webcast Meeting on SAC Solder Joint Fragility, Binghamton, NY, Sep. 2004.

S. K. Saha, et al., "Effect of Intermetallic Phases on Performance in a Mechanical Drop Environment: 96.5Sn3.5Ag Solder on Cu and Ni/Au Pad Finishes", ECTC, S29p5, Jun. 2004.

M. Amagai, et al., "High Drop Test Reliability: Lead Free Solders", ECTC, S29p7, Jun. 2004.

T. Gregorich, et al., "SnNi and SnNiCu Intermetallic Compounds Found When using SnAgCu Solders", IPC/Soldertec Global 2nd International Conference on Lead Free Electronics, Amsterdam, Netherland, Jun. 23, 2004.

M. Date, et al., "Impact Reliability of Solder Joints", ECTC, Jun. 2004.

P. A. Kondos & S. Mandke, "Kirkendall voiding in Cu pads and other pad issues", UIC Fragile SAC Joint Meeting, Binghamton, NY, Oct. 7, 2004.

M. Date, et al., "Pb-free Solder Ball with Higher Impact Reliability", Intel Pb-free Technology forum, Jul. 18-20, 2005, Penang, Malaysia.

A. Syed, "Interaction of Pb free Solder Alloys and Package Pad Finish on Drop/Impact Reliability of CSP packages", Amkor Technology®, Mar. 14, 2006.

European Search Report, EP Application No. 06848579.6-2122, dated Nov. 27, 2008.

International Search Report and Written Opinion for International App. No. PCT/US2012/058347, mailed Feb. 5, 2013, Authorized Officer: Galatiota, Maruska.

State of Intellectual Property Office of PRC, First Office Action, App No. 200680046350.5, issued Apr. 11, 2010.

State of Intellectual Property Office of PRC, Second Office Action, App. No. 200680046350.5, dated Jun. 18, 2010.

State of Intellectual Property Office of PRC, Third Office Action, App. No. 200680046350.5, Issued Nov. 23, 2011.

State of Intellectual Property Office of PRC, Fourth Office Action, App No. 200680046350.5, Issued Aug. 23, 2012.

State of Intellectual Property Office of PRC, Decision of Rejection, App. No. 200680046350.5, Issued Mar. 5, 2013.

State of Intellectual Property Office of PRC, Notification of Reexamination, App. No. 200680046350.5, Issued Oct. 17, 2014.

State of Intellectual Property Office of PRC, First Office Action, App No. 201280048936.0, Issued Dec. 2, 2014.

Weiping Liu et al., The Effects of Additives to SnAngCu Alloys on Microstructure and Drop Impact Reliability of Solder Joints, JOM, vol. 59, No. 7, pp. 26-31, Jul. 1, 2007.

Weiping Liu et al., The Superior Drop Test Performance of SAC-TI Solders and Its Mechanism, Electronic Technology Symposium2008 33rd IEEE/CPMT, Nov. 4, 2008, pp. 1-9, NJ. US.

* cited by examiner

| | Solder composition (wt.%) | | | | Average number of drops to failure | STDEV[1] | Drop height (meters) |
|---|---|---|---|---|---|---|---|
| No.[2] | Sn | Ag | Cu | Mn,Ce,Bi,Ti,Y | | | |
| 1 | Bal. | 1.07 | 0.47 | 0.08 Mn | 8.4 | 2.37 | 0.5 |
| 2 | Bal. | 1.1 | 0.64 | 0.13 Mn | 35.4 | 19.25 | 0.5 |
| 3 | Bal. | 1.13 | 0.6 | 0.16 Mn | 23.5 | 6.4 | 0.5 |
| 4 | Bal. | 1.1 | 0.45 | 0.25 Mn | 5.6 | 2.63 | 0.5 |
| 5 | Bal. | 1.07 | 0.58 | 0.04 Ce | 20.9 | 6.51 | 0.5 |
| 6 | Bal. | 1.05 | 0.56 | 0.3 Bi | 14.6 | 5.54 | 0.5 |
| 7 | Bal. | 1.05 | 0.73 | 0.07 Ti | 10.6 | 7.47 | 0.5 |
| 8 | Bal. | 1.16 | 0.5 | 0.08 Y | 6.6 | 2.72 | 0.5 |
| 9 | Bal. | 1.0 | 0.46 | 0.3 Bi, 0.1 Mn | 11.9 | 6.51 | 0.5 |
| 10 | Bal. | 1.05 | 0.46 | 0.6 Bi, 0.07 Mn | 9.7 | 4.69 | 0.5 |
| 11 | Bal. | 1.19 | 0.49 | 0.4 Bi, 0.06 Y | 10.6 | 6.98 | 0.5 |
| 12 | Bal. | 1.15 | 0.46 | 0.8 Bi, 0.08 Y | 6.3 | 4.32 | 0.5 |
| 13 | Bal. | 1.05 | 0.64 | 0.2 Mn, 0.02 Ce | 28.5 | 16.56 | 0.5 |
| 14 | Bal. | 3.0 | 0.5 | | 1.2 | 0.42 | 0.5 |
| 15 | Bal. | 3.8 | 0.7 | | 1.1 | 0.32 | 0.5 |
| 16 | Bal. | 1.0 | 0.5 | | 5.1 | 1.85 | 0.5 |
| 17 | Bal. | | | 37 Pb [3] | 23.8 | 14.33 | 0.5 |
| 18 | Bal | | 0.63 | 0.12 Mn | 23.0 | 13.99 | 0.5 |
| 19 | Bal. | 1.76 | 0.68 | 0.15 Mn | 12.1 | 9.65 | 0.5 |
| 20 | Bal. | 2.59 | 0.65 | 0.12 Mn | 6.0 | 2.31 | 0.5 |
| 21 | Bal. | 3.09 | 0.64 | 0.14 Mn | 2.4 | 0.7 | 0.5 |
| 22 | Bal. | 3.26 | 0.44 | 0.08 Y | 6.0 | 2.0 | 0.25 |
| 23 | Bal. | 3.23 | 0.42 | 0.3 Y | 6.0 | 1.5 | 0.25 |
| 24 | Bal. | 3.0 | 0.5 | | 2.75 | 1.7 | 0.25 |

(1) STDEV=standard deviation
(2) Nos. 1 to 13 and Nos. 18 to 23 are solder alloys formulated in accordance with embodiments of the present disclosure; and Nos. 14 to 17 and No. 24 are control solder alloys for comparison purposes.
(3) Eutectic Sn-Pb solder alloy.

Figure 1

| Alloys | Solidus (°C) | Liquidus (°C) |
|---|---|---|
| Sn1.1Ag0.64Cu0.13Mn | 217.52 | 227.26 |
| Sn1.13Ag0.6Cu0.16Mn | 217.81 | 225.98 |
| Sn1.07Ag0.58Cu0.037Ce | 217.65 | 226.14 |
| Sn1.05Ag0.73Cu0.067Ti | 217.59 | 227.56 |
| Sn1.16Ag0.5Cu0.08Y | 217.43 | 226.56 |
| Sn1.05Ag0.56Cu0.3Bi | 216.98 | 226.03 |
| Sn1.0Ag0.46Cu0.3Bi0.1Mn | 216.22 | 226.98 |
| Sn1.19Ag0.49Cu0.4Bi0.06Y | 216.87 | 227.10 |
| Sn1.05Ag0.64Cu0.2Mn0.02Ce | 217.22 | 225.43 |
| Sn1.0Ag0.5Cu (SAC105) | 217.18 | 226.80 |
| Sn3.0Ag0.5Cu (SAC305) | 217.64 | 222.81 |
| Sn37Pb | 180.75 | 183.72 |

Figure 2

| | Solder composition (wt.%) | | | | Average number of drops to failure | STDEV[1] | Drop height (meter) |
|---|---|---|---|---|---|---|---|
| No. | Sn | Ag | Cu | Mn,Ce,Bi,Ti,Y | | | |
| 1 | Bal. | 1.07 | 0.47 | 0.085 Mn | 17.1 | 12.86 | 0.5 |
| 2 | Bal. | 1.1 | 0.64 | 0.13 Mn | 39.3 | 42.72 | 0.5 |
| 3 | Bal. | 1.13 | 0.6 | 0.16 Mn | 23.7 | 16.21 | 0.5 |
| 4 | Bal. | 1.1 | 0.45 | 0.25 Mn | 5.8 | 3.94 | 0.5 |
| 5 | Bal. | 1.07 | 0.58 | 0.04 Ce | 23.2 | 23.34 | 0.5 |
| 6 | Bal. | 1.05 | 0.56 | 0.3 Bi | 5.1 | 2.28 | 0.5 |
| 7 | Bal. | 1.05 | 0.73 | 0.07 Ti | 18.7 | 24.93 | 0.5 |
| 8 | Bal. | 1.16 | 0.5 | 0.08Y | 8.7 | 4.45 | 0.5 |
| 9 | Bal. | 1.0 | 0.46 | 0.3 Bi, 0.1 Mn | 23.4 | 29.89 | 0.5 |
| 10 | Bal. | 1.05 | 0.46 | 0.6 Bi, 0.07 Mn | 11.1 | 9.1 | 0.5 |
| 11 | Bal. | 1.19 | 0.49 | 0.4 Bi, 0.06 Y | 17.5 | 19.56 | 0.5 |
| 12 | Bal. | 1.15 | 0.46 | 0.8 Bi, 0.08 Y | 11.7 | 6.34 | 0.5 |
| 13 | Bal. | 1.05 | 0.64 | 0.2 Mn, 0.02 Ce | 6.0 | 5.42 | 0.5 |
| 14 | Bal. | 3.0 | 0.5 | | 1.0 | 0.0 | 0.5 |
| 15 | Bal. | 3.8 | 0.7 | | 1.0 | 0.0 | 0.5 |
| 16 | Bal. | 1.0 | 0.5 | | 5.4 | 2.91 | 0.5 |
| 17 | Bal. | | | 37 Pb | 4.0 | 3.06 | 0.5 |

(1) STDEV=standard deviation.

Figure 3

LEAD-FREE SOLDER ALLOYS AND SOLDER JOINTS THEREOF WITH IMPROVED DROP IMPACT RESISTANCE

CROSS-REFERENCE TO RELATED APPLICATIONS

This patent application claims priority to U.S. Provisional Patent Application No. 60/749,615, filed Dec. 13, 2005, which is hereby incorporated by reference herein in its entirety.

FIELD OF THE DISCLOSURE

The present disclosure relates generally to lead-free solder alloy compositions for use in electronics and, in particular, to lead-free solder alloys and solder joints thereof with improved drop impact resistance.

BACKGROUND OF THE DISCLOSURE

Among the various lead-free solder alloy choices as replacements of conventional tin-lead solders, Tin (Sn)-Silver (Ag)-Copper (Cu) alloys are currently the most popular because of their relatively good soldering performance, excellent creep resistance, and thermal fatigue reliability, as well as their compatibility with the current components. A variety of Sn—Ag—Cu solder alloys have been proposed and recommended for use by industrial organizations in different countries. For example, Sn-3.0Ag-0.5Cu (wt. %) by the Japan Electronic Industry Development Association (JEIDA) in Japan, Sn-3.8Ag-0.7Cu (wt. %) by the European Consortium BRITE-EURAM in the European Union, and Sn-3.9Ag-0.6Cu (wt. %) by the National Electronics Manufacturing Initiative (NEMI) in the United States of America. However, recent investigations on the lead-free solder alloys have shown that solder joints made from these recommended Sn—Ag—Cu alloys may be fragile and prone to premature interfacial failure under drop impact loading. Although reduction of Ag content in Sn—Ag—Cu alloys has been found to be helpful, drop test performance for these alloys is still inferior to that of eutectic tin-lead. Traditionally, solder joint reliability has been evaluated mainly by thermal fatigue performance since thermal fatigue fracture has been the critical failure mode in electronics interconnects. As the industry is pushing for device miniaturization and increased use of portable electronic products, impact reliability of solder joints in electronic packages becomes critical, in addition to conventional thermal fatigue reliability.

In view of the forgoing, it would be desirable to provide Sn—Ag—Cu based solder alloys and solder joints thereof with improved drop impact reliability.

SUMMARY OF THE DISCLOSURE

Lead-free solder alloys and solder joints thereof with improved drop impact resistance are disclosed. In one particular exemplary embodiment, the lead-free solder alloys preferably comprise 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

In accordance with other aspects of this particular exemplary embodiment, the preferred content of Ag is 0.0-2.6 wt. %.

In accordance with further aspects of this particular exemplary embodiment, the preferred content of Mn is 0.01-0.3 wt. %.

In accordance with additional aspects of this particular exemplary embodiment, the preferred content of Ce is 0.01-0.2 wt. %.

In accordance with still other aspects of this particular exemplary embodiment, the preferred content of Ti is 0.01-0.2 wt. %.

In accordance with still further aspects of this particular exemplary embodiment, the preferred content of Y is 0.01-0.4 wt. %.

In accordance with still additional aspects of this particular exemplary embodiment, the preferred content of Bi is 0.01-0.5 wt. %.

In accordance with yet still additional aspects of this particular exemplary embodiment, the lead-free solder alloy may electronically join substrate surface finishes formed using one or more of: electroplated Ni/Au, electroless Ni immersion Au (ENIG), organic solderability preservatives (OSP), immersion Ag, and immersion Sn.

In another particular exemplary embodiment, a solder ball may be formed of a lead-free solder alloy preferably comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

In still another particular exemplary embodiment, a solder powder may be formed of a lead-free solder alloy preferably comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

In yet another particular exemplary embodiment, a solder paste may comprise a solder powder formed of a lead-free solder alloy preferably comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

In still another particular exemplary embodiment, a ball grid array (BGA) for arranging electronic components on printed circuit boards may comprise solder balls formed of a lead-free solder alloy preferably comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

In yet another particular exemplary embodiment, a solder joint within an electronic device may be formed of a lead-free solder alloy preferably comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

The present disclosure will now be described in more detail with reference to exemplary embodiments thereof as shown in the accompanying drawings. While the present disclosure is described below with reference to exemplary embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be exemplary only.

FIG. 1 is a table showing comparative drop impact resistance data for as-reflowed solder joints formed of example solder alloys formulated in accordance with embodiments of the present disclosure and control solder alloys.

FIG. 2 is a table showing comparative melting behavior of example solder alloys formulated in accordance with embodiments of the present disclosure and control solder alloys.

FIG. 3 is a table showing comparative drop impact resistance data for as-reflowed solder joints formed of example solder alloys formulated in accordance with embodiments of the present disclosure and control solder alloys after thermal aging at 150° C. for four weeks.

DETAILED DESCRIPTION OF EXEMPLARY EMBODIMENTS

Figure 4:
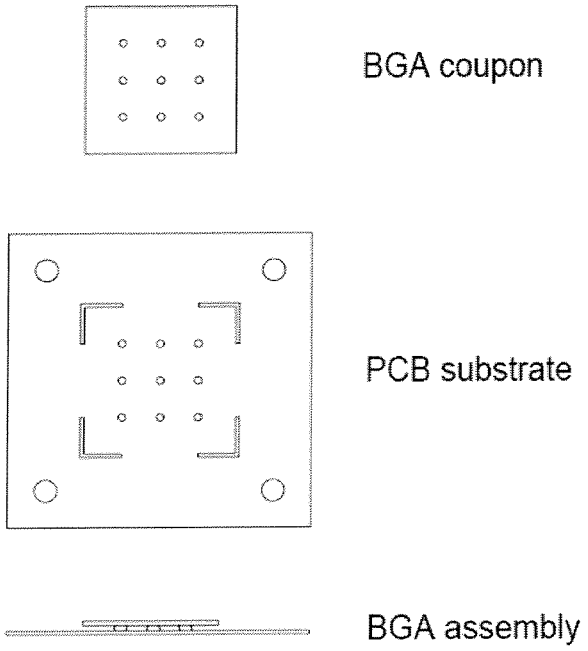
FIG. 4 shows a BGA test coupon, a PCB substrate, and a resulting simulated BGA assembly formed therefrom for testing solder joints formed of example solder alloys formulated in accordance with embodiments of the present disclosure.

The present disclosure relates to Sn—Ag—Cu based (i.e., lead-free) solder alloys and solder joints thereof with improved drop impact reliability. The disclosed Sn—Ag—Cu based solder alloys preferably comprise 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn.

Solder joints made of the above-described lead-free solder alloys have a higher drop impact resistance, compared to those made of the conventional Sn—Ag—Cu solder alloys that have been recommended and are currently in use in the industry.

The disclosed Sn—Ag—Cu based solder alloys are particularly suitable for, but not limited to, producing solder bumps such as those in ball grid array (BGA) packages which require high drop impact reliability especially when used in mobile and portable electronic products.

Referring to FIG. 1, there is shown a table showing comparative drop impact resistance data for as-reflowed solder joints formed of example solder alloys formulated in accordance with embodiments of the present disclosure and control solder alloys. The example solder alloys formulated in accordance with embodiments of the present disclosure include Sn—Ag—Cu based solder alloys comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn. The control solder alloys include Sn-3.0Ag-0.5Cu, Sn-3.8Ag-0.7Cu, Sn-1.0Ag-0.5Cu, and 63Sn37Pb solders. As shown in the table of FIG. 1, the example solder alloys formulated in accordance with embodiments of the present disclosure exhibit superior drop impact resistance performance.

Referring to FIG. 2, there is shown a table showing comparative melting behavior of example solder alloys formulated in accordance with embodiments of the present disclosure and control solder alloys. The example solder alloys formulated in accordance with embodiments of the present disclosure include Sn—Ag—Cu based solder alloys comprising 0.0-4.0 wt. % of Ag, 0.01-1.5 wt. % of Cu, at least one of the following additives: Mn in an amount of 0.001-1.0 wt. %, Ce in an amount of 0.001-0.8 wt. %, Y in an amount of 0.001-1.0 wt. %, Ti in an amount of 0.001-0.8 wt. %, and Bi in an amount of 0.01-1.0 wt. %, and the remainder of Sn. The control solder alloys include Sn-3.0Ag-0.5Cu, Sn-3.8Ag-0.7Cu, Sn-1.0Ag-0.5Cu, and 63Sn37Pb solders. The melting temperature ranges of the solder alloys were measured with Differential Scanning Calorimetry (DSC). The mass of sample for DSC was around 5-15 mg, and the scanning rate was 10° C./min. For each solder alloy, the sample was scanned twice. The sample was first scanned from ambient temperature up to 350° C., followed by cooling down to ambient temperature naturally, then scanned again up to 350° C. The second scanning thermograph was used to represent the melting behavior of alloys. As shown in the table of FIG. 2, the addition of a small amount of additives in accordance with the present disclosure has a negligible effect on the melting behavior of the corresponding Sn—Ag—Cu solder alloys. Thus, the use of solder alloys in accordance with the present disclosure is consistent with the condition for use of conventional Sn—Ag—Cu solder alloys.

Figure 5:
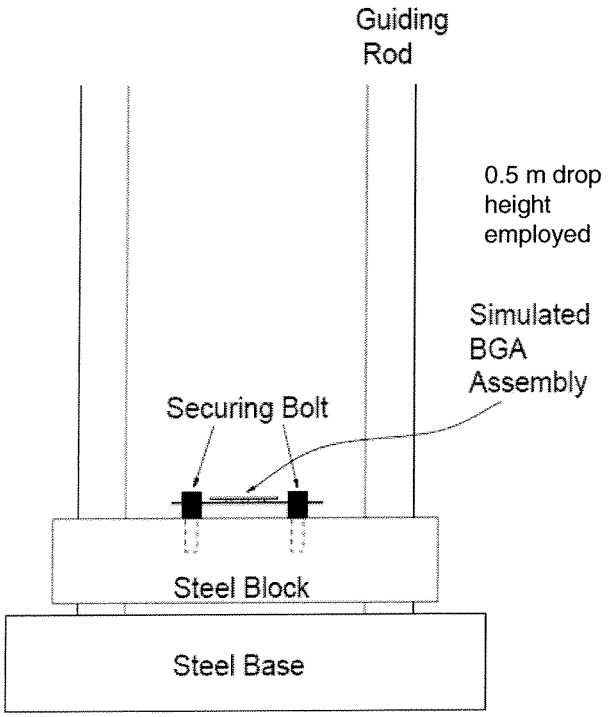
FIG. 5 shows a drop impact resistance tester for testing solder joints formed of example solder alloys formulated in accordance with embodiments of the present disclosure.

The drop impact resistance of solder joints was evaluated using a drop tester such as shown in FIG. 5. Drop tests were conducted using a simulated BGA assembly such as shown in FIG. 4. The simulated BGA assembly comprised a BGA coupon and a printed circuit board (PCB) substrate. The BGA coupon, such as shown in FIG. 4, comprised a 40 mm×40 mm substrate, with a 3×3 array of distributed electroplated Nickel/Gold (Ni/Au) pads (2 mm diameter). The PCB substrate, such as shown in FIG. 4, was a 80 mm×80 mm substrate, with a corresponding 3×3 array of distributed electroplated Nickel/Gold (Ni/Au) pads (2 mm diameter) and 4 drilled holes (6 mm diameter) at the corners of the substrate for mounting the resulting simulated BGA assembly onto a steel drop block with four securing bolts (see FIG. 5).

Solder joints were formed between the corresponding pads in the 3×3 arrays of distributed electroplated Nickel/Gold (Ni/Au) pads on the BGA coupon and the PCB substrate. Each solder joint in the simulated BGA assembly was made of approximately 50 mg of solder alloy. To produce the simulated BGA assembly, solder spheres of a given alloy were first mounted onto the PCB substrate with the use of a no-clean flux, and reflowed using a reflow profile with a peak temperature 240° C. This bumped PCB substrate was then mounted to the BGA coupon, which was preprinted with the same no-clean flux on its pads and reflowed with the same profile.

The simulated BGA assembly was mounted onto the steel drop block with the four securing bolts (see FIG. 5). The clearance between the PCB substrate and the steel drop block was 5 mm. A strong drop impact was produced and imparted to the simulated BGA assembly by raising the steel drop block along two guiding rods to a certain height and then releasing the drop block and allowing it to drop freely along the guiding rods until hitting a steel base (see FIG. 5). The drop impact caused the PCB substrate in the simulated BGA assembly to vibrate on the four securing bolts, and the vibration in turn produced a drop impact in the solder joints in the simulated BGA assembly. The height used for drop tests was mostly 0.5 meters, but a reduced height of 0.25 meters was also used in some cases for solder alloys with a higher Ag content. Drop tests were conducted on the simulated BGA assembly both at the as-reflowed condition and after thermal aging at 150° C. for four weeks. For each test condition, 10 simulated BGA assemblies were used. The number of drops to failure (i.e., separation of the assembly) was used as the basis for comparison of the drop impact resistance of the solder joints. The higher the number of drops to failure, the greater the resistance to drop impact of the solder joint. Also, the greater the drop height used in testing, the higher the intensity of drop impact produced during testing.

The drop test results for the solder alloys formulated in accordance with embodiments of the present disclosure and the control solder alloys for the as-reflowed condition are shown in the table of FIG. 1. The conventional Sn-3.8Ag-0.7Cu (SAC387) and Sn-3.0Ag-0.5Cu (SAC305) alloys survived on average only 1.1 and 1.2 drops before failure, respectively. The conventional Sn-1.0Ag-0.5Cu (SAC105) alloy exhibited a mean drop number of 5.1, and thus was considerably better than SAC387 and SAC305. As shown in the table of FIG. 1, the solder alloys No. 1 to No. 13 that were formulated in accordance with embodiments of the present disclosure all exhibited a superior drop test performance than SAC105. The content of dopants in the solder alloys formulated in accordance with embodiments of the present disclosure also significantly influenced the drop test performances. For example, in the case of a Manganese (Mn) dopant (e.g., example solder alloys No. 1 to No. 4), the drop test performance improved with increasing Mn content, reaching a maximum mean value of 35.4 at 0.13 wt. % Mn content, and then decreasing with a further increase in Mn content.

Figure 6:
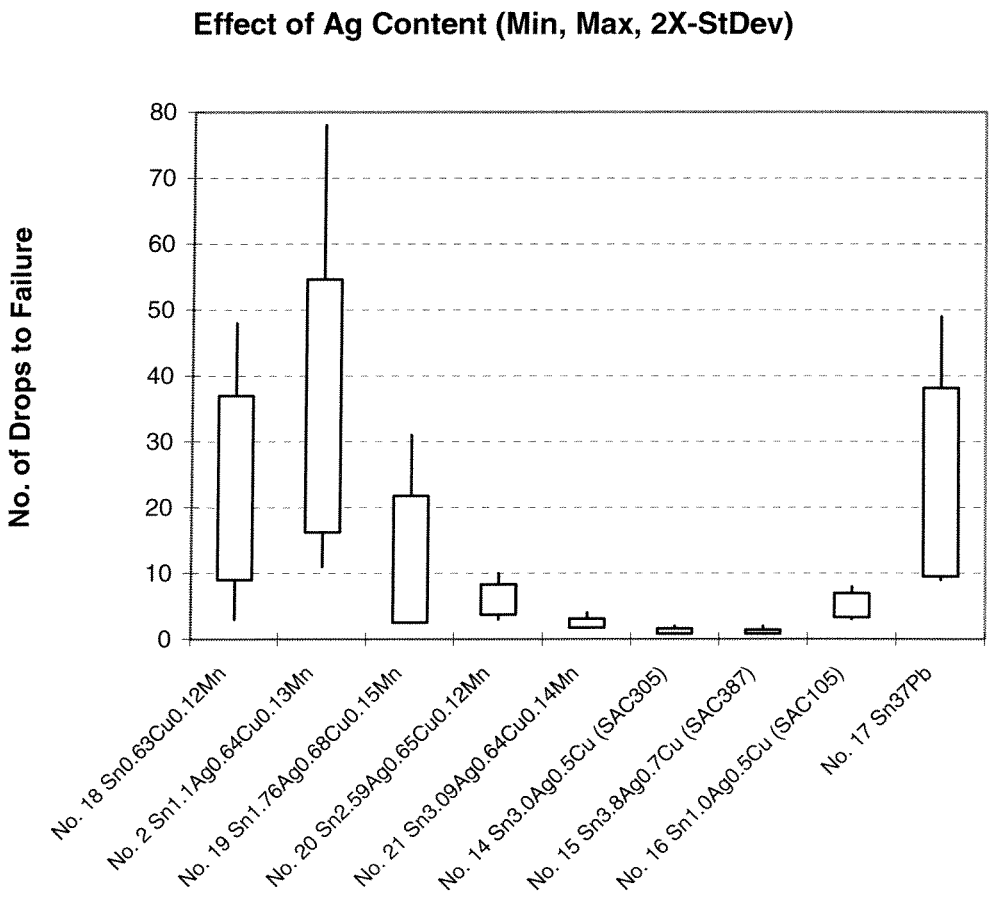
FIG. 6 is a chart showing the comparative effect of the Ag content on drop impact performance for as-reflowed solder joints of Sn—Ag—Cu—Mn solder alloys formulated in accordance with embodiments of the present disclosure and control solder alloys.

Referring to FIG. 6, there is shown is a chart showing the comparative effect of the Ag content on drop impact performance for as-reflowed solder joints of Sn—Ag—Cu—Mn solder alloys formulated in accordance with embodiments of the present disclosure and control solder alloys. Thus, FIG. 6 shows the effect of an Mn dopant on drop test performance of solder joints with various Ag content levels for the as-reflowed condition. In the chart of FIG. 6, the lower end of each vertical line denotes a minimum drop number, and the upper end of each vertical line denotes a maximum drop number, while each box represents two times the standard deviation, with the mean drop number being at the center of the box for each of the solder alloys. At an Mn dopant content of about 0.13 wt. %, the mean drop number was 23.0, 35.4, 12.1, 6.0, and 2.4 for solder alloys with an Ag content level of 0.0, 1.1, 1.76, 2.59, and 3.09 wt. %, respectively. Except for the solder alloy with 3.09 wt. % Ag, all other solder alloys with a lower Ag content level exhibited a mean value greater than that of SAC105 (mean value 5.1), not to mention SAC305 (mean value 1.2) and SAC387 (mean value 1.1). The drop test performance of example solder alloy No. 2, with a composition of Sn1.1Ag0.64Cu0.13Mn, was even better than the 63Sn37Pb solder alloy. Although a lower Ag content generally results in a better drop test performance for a Sn—Ag—Cu (SAC) solder alloy, the use of an Mn dopant essentially elevates the drop test performance of a 2.6 wt. % Ag alloy to that of SAC105.

Figure 7:
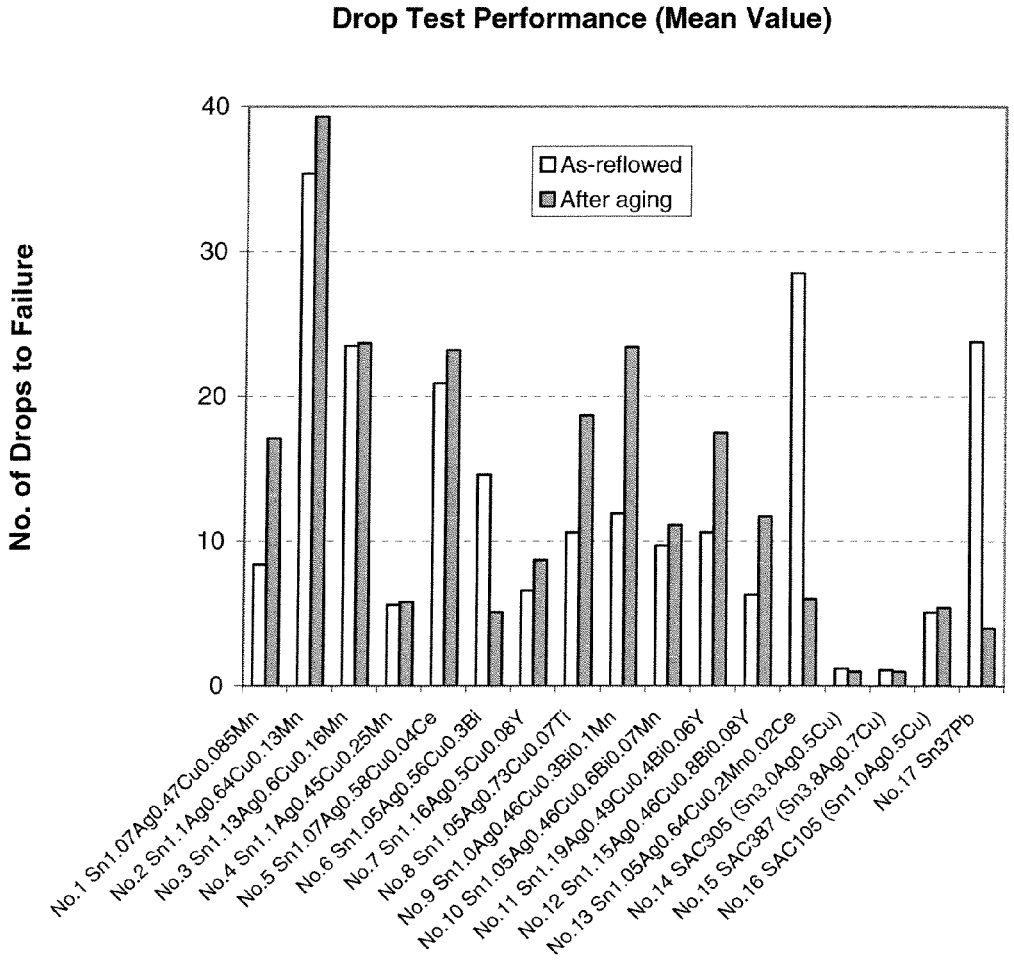
FIG. 7 is a chart showing comparative mean drop impact performance for as-reflowed and aged solder joints formed of example solder alloys formulated in accordance with embodiments of the present disclosure and control solder alloys.

Referring to FIG. 3, there is shown a table showing comparative drop impact resistance data for as-reflowed solder joints formed of example solder alloys formulated in accordance with embodiments of the present disclosure and control solder alloys after thermal aging at 150° C. for four weeks. Comparing the data at the as-reflowed condition as shown in FIG. 1 versus the thermally aged condition as shown in FIG. 3, it is revealed that while the mean drop number for the 63Sn37Pb eutectic alloy deteriorates significantly from 28.5 down to 4.0 after thermal aging, the solder alloys formulated in accordance with embodiments of the present disclosure generally exhibit a higher mean drop number after thermal aging except for the solder alloys No. 6 and No. 13 (see FIG. 7). The improvement of drop impact resistance with thermal aging is a good indication of reliability of solder joints made of the solder alloys formulated in accordance with embodiments of the present disclosure.

Based on the data presented above, the solder alloys formulated in accordance with embodiments of the present disclosure exhibited excellent drop impact resistance, and was superior to that of conventional SnAgCu solders (such as SAC305 and SAC105). Indeed, some of the solder alloys formulated in accordance with embodiments of the present disclosure had drop impact resistance performance even better than that of the SnPb eutectic alloy. The solder bumps or joints made from the solder alloys formulated in accordance with embodiments of the present disclosure have superior properties to those of conventional solder alloys. For instance, when a solder alloy formulated in accordance with embodiments of the present disclosure is used as a solder ball and/or solder powder in a solder paste to connect a BGA or CSP package to a PCB, the solder joint thus formed may not be readily damaged by detaching either from the PCB or from the package when the assembly is subject to a drop impact load during shipping, handling, or in use. As a result, the reliability of electronic equipment may be greatly improved due to the use of solder alloys formulated in accordance with embodiments of the present disclosure.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. A lead-free solder alloy consisting essentially of an amount of Ag greater than 0 wt. % and less than or equal to about 2.6 wt. %, 0.01-1.5 wt. % of Cu, and at least one of the following additives: Mn in an amount of 0.001-1.0 wt. %, and Ti in an amount of 0.001-0.8 wt. %, and the remainder of Sn.

2. The lead-free solder alloy of claim 1, wherein the content of Mn is 0.01-0.3 wt. %.

3. The lead-free solder alloy of claim 1, comprising Ti, and wherein the content of Ti is 0.01-0.2 wt. %.

4. A solder ball formed of a lead-free solder alloy as recited in claim 1.

5. A solder powder formed of a lead-free solder alloy as recited in claim 1.

6. A solder paste comprising a solder powder formed of a lead-free solder alloy as recited in claim 1.

7. A ball grid array (BGA) for arranging electronic components on printed circuit boards, wherein solder balls in the BGA are formed of a lead-free solder alloy as recited in claim 1.

8. A solder joint within an electronic device, wherein the solder joint is formed of a lead-free solder alloy as recited in claim 1.

9. The lead-free solder alloy of claim 1, wherein the lead-free solder alloy electronically joins substrate surface finishes formed using one or more of: electroplated Ni/Au, electroless Ni immersion Au (ENIG), organic solderability preservatives (OSP), immersion Ag, and immersion Sn.

10. A lead-free solder alloy consisting essentially of an amount of Ag greater than 0 wt. % less than or equal to about 2.6 wt. %, 0.01-1.5 wt. % of Cu, and at least one of the following additives: Mn in an amount of 0.001-1.0 wt. %, and Ti in an amount of 0.001-0.8 wt. %, and at least one of the further following additives: Ce in an amount of 0.001-0.8 wt. %, Y in an amount of 0.001-1.0 wt. %, and Bi in an amount of 0.01-1.0 wt. %, and the remainder of Sn.

11. The lead-free solder alloy of claim 10, wherein the content of Ce is 0.01-0.2 wt. %.

12. The lead-free solder alloy of claim 10, wherein the content of Y is 0.01-0.4 wt. %.

13. The lead-free solder alloy of claim 10, wherein the content of Bi is 0.01-0.5 wt. %.

14. The lead-free solder alloy of claim 10, wherein the content of Mn is 0.01-0.3 wt. %.

15. The lead-free solder alloy of claim 10, wherein the content of Ti is 0.01-0.2 wt. %.

16. A solder ball formed of a lead-free solder alloy as recited in claim 10.

17. A solder powder formed of a lead-free solder alloy as recited in claim 10.

18. A solder paste comprising a solder powder formed of a lead-free solder alloy as recited in claim 10.

19. A ball grid array (BGA) for arranging electronic components on printed circuit boards, wherein solder balls in the BOA are formed of a lead-free solder alloy as recited in claim 10.

20. A solder joint within an electronic device, wherein the solder joint is formed of a lead-free solder alloy as recited in claim 10.

* * * * *

UNITED STATES PATENT AND TRADEMARK OFFICE

CERTIFICATE OF CORRECTION

PATENT NO. : 9,260,768 B2
APPLICATION NO. : 11/567525
DATED : February 16, 2016
INVENTOR(S) : Weiping Liu et al.

It is certified that error appears in the above-identified patent and that said Letters Patent is hereby corrected as shown below:

In the claims

Claim 19, Column 8, line 22, "BOA" should read --BGA--

Signed and Sealed this
Seventeenth Day of May, 2016

Michelle K. Lee

Michelle K. Lee
*Director of the United States Patent and Trademark Office*